United States Patent [19]

Pringle

[11] Patent Number: 4,709,762

[45] Date of Patent: Dec. 1, 1987

[54] VARIABLE FLUID PASSAGEWAY FOR A WELL TOOL

[75] Inventor: Ronald E. Pringle, Houston, Tex.

[73] Assignee: Camco, Incorporated, Houston, Tex.

[21] Appl. No.: 941,973

[22] Filed: Dec. 15, 1986

Related U.S. Application Data

[63] Continuation-in-part of Ser. No. 789,234, Oct. 18, 1985, Pat. No. 4,629,002.

[51] Int. Cl.[4] ..... E21B 34/10

[52] U.S. Cl. ..... 166/324; 166/242

[58] Field of Search ..... 166/319, 321, 324, 242; 175/297

[56] References Cited

U.S. PATENT DOCUMENTS

| | | | |
|---|---|---|---|
| 3,845,818 | 11/1974 | Deaton | 166/322 |
| 3,938,589 | 2/1976 | Mott | 175/242 |
| 4,007,798 | 2/1977 | Gazda | 175/297 |
| 4,161,219 | 2/1984 | Pringle | 166/324 |
| 4,325,431 | 4/1982 | Akkerman | 166/321 |
| 4,373,587 | 2/1983 | Pringle | 166/324 |
| 4,431,054 | 2/1984 | Woodman | 166/117.7 |
| 4,454,913 | 6/1984 | Guidry et al. | 166/322 |
| 4,569,398 | 2/1986 | Pringle | 166/324 |

*Primary Examiner*—Stephen J. Novosad
*Assistant Examiner*—Terry Lee Melius
*Attorney, Agent, or Firm*—Fulbright & Jaworski

[57] ABSTRACT

A well tool having a housing which includes a pressure reducing and fluid velocity reducing passageway. The passageway is formed by first and second vertically positioned members spaced from each other. The first member includes a tapered surface having plurality of grooves and ridges and the second member includes a tapered surface facing the grooves and ridges. Threads are provided for longitudinally moving one of the members relative to the other member for adjusting the space between the members thereby adjusting the size of the passage way. The one member may include an outer portion of the housing or may include a sleeve inside of the housing. A lock is provided for locking the first and second members together after adjustment of the size of the passageway.

10 Claims, 9 Drawing Figures

VARIABLE FLUID PASSAGEWAY FOR A WELL TOOL

CROSS-REFERENCE TO RELATED APPLICATIONS

This application is a continuation-in-part of application Ser. No. 06/789,234, filed Oct. 18, 1985, entitled Equalizing Means for a Subsurface Well Safety Valve, and now U.S. Pat. No. 4,629,002.

BACKGROUND OF INVENTION

It is desirable to provide a pressure reducing and flow velocity reducing passageway in a well tool for oil and/or gas wells. For example, in the above-described patent application a labyrinth passageway is provided in the equalizing line of a well subsurface safety valve for creating controlled pressure drops along the equalizing line to reduce the pressure and flow velocity for minimizing flow cutting and erosion of fluids flowing through the equalizing line. However, in oil and gas wells, various conditions may exist such as sand in the well production, or different viscosities of well production which would require variations in the size of the flow passageway. The present invention is directed to a well tool having a flow passageway which is variable and can be set to accommodate various well conditions thereby avoiding manufacturing of different well tools with different size flow passageways.

SUMMARY

The present invention is directed to a well tool having a housing which includes a pressure reducing and flow velocity reducing passageway. The passageway is formed by first and second vertically positioned members spaced from each other. The first member includes a plurality of grooves and ridges and the second member includes a tapered surface facing the grooves and ridges. Means are provided for longitudinal moving one of the members relative to the other member for adjusting the space between the members thereby adjusting the size of the passageway.

A further object of the present invention is wherein the moving means includes thread means between the one member and the housing. In one embodiment, the one member includes an outer portion of the housing and in another embodiment the one member is a sleeve inside of the housing.

Yet a still further object of the present invention is the provision of locking means for locking the first and second members together after adjustment of the size of the passageway.

Still a further object of the present invention is the provision in combination subsurface well safety valve for controlling fluid flow through a well tubing and having a housing, a first valve being movable between an open and closed position for controlling flow through the housing, a flow tube telescopically movable in the housing for controlling the opening and closing of the first valve and means for moving the flow tube for opening and closing the first valve, of an equalizing means for reducing the pressure differential across the first valve when opening the first valve. The equalizing means includes an equalizing line extending between points below and above the first valve and an equalizing valve is provided in the line. A variable labryinth flow passageway is provided in equalizing line upstream of the equalizing valve for providing pressure drops for controlling the velocity of the fluid flowing through the equalizing valve.

Other and further objects, features and advantages will be apparent from the following description of a presently preferred embodiment of the invention, giving gor the purpose of disclosure and taken in conjunction with the accompanying drawings.

DESCRIPTION OF THE PREFERRED EMBODIMENT

Figure 1A:
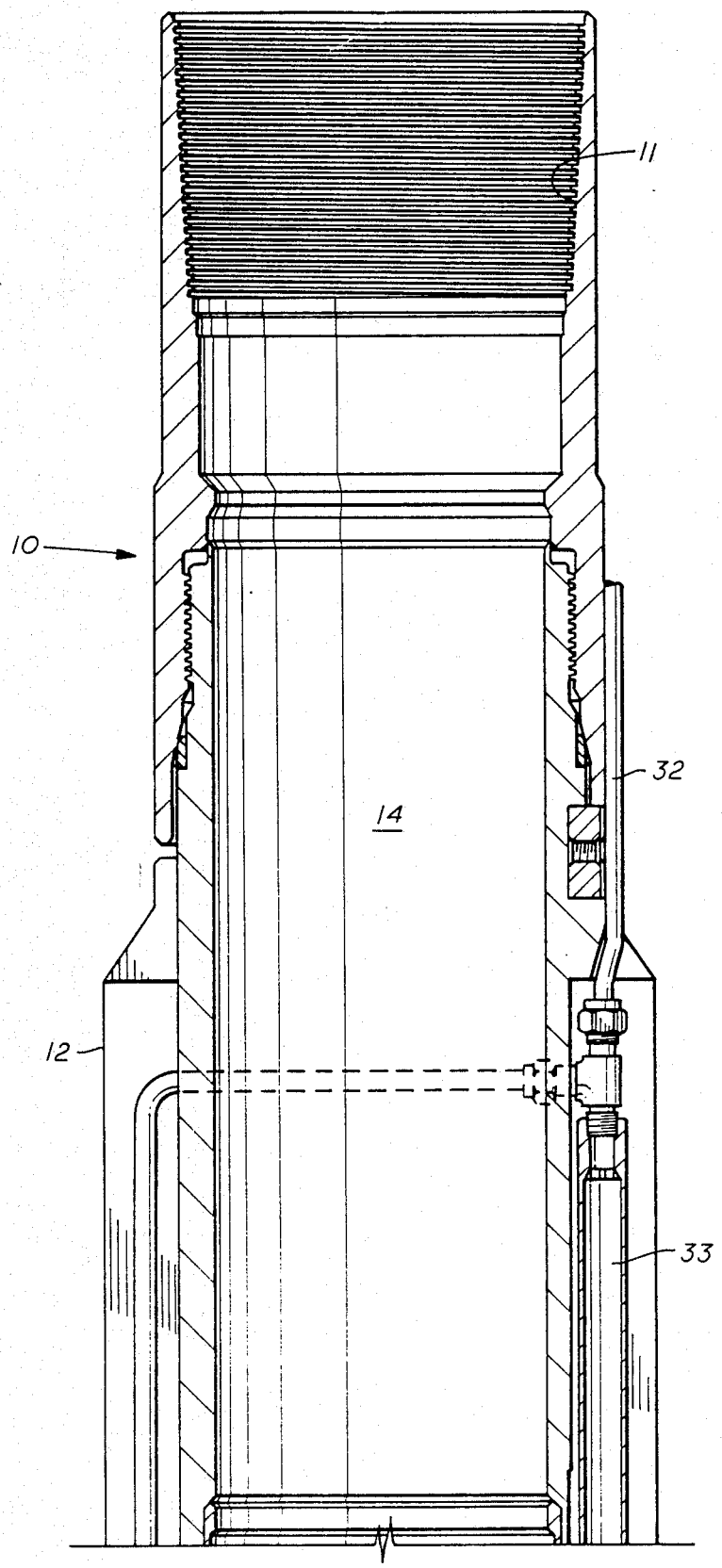
FIGS. 1A, 1B, 1C, 1D and 1E are continuations of each other and form an elevational view, in cross section, of a subsurface safety valve utilizing the present invention.

While the present improvements in a variable fluid passageway will be described in connection with its use in a tubing retrievable safety valve, it will be understood the present invention may be used with other types of well tools.

Referring now to the drawings, a subsurface safety valve using the present invention is generally indicated by the reference numeral 10 and is shown as being of a non-retrievable type for connection in a well conduit or tubing (not shown) such as by a threaded box 11 at one end and a threaded pin 13 at the other end. The safety valve 10 generally includes a body or housing 12 adapted to permit well production therethrough under normal operating conditions but in which the safety valve 10 may close or be closed in response to abnormal conditions.

The safety valve 10 generally includes a bore 14, an annular valve seat 16 (FIG. 1E), a valve closure element or flapper valve 18 connected to the body 12 by a pivot pin 20. A flow tube 22 is telescopically movable in the body 12 and through the valve seat 16. As best seen in FIG. 1E, when the flow tube 22 is moved to a downward position, the tube 22 pushes the flapper 18 away from the valve seat 16. Thus valve 10 is held in the open position so long as the flow tube 22 is in the downward position. When the flow tube 22 is moved upwardly, the flapper 18 is allowed to move upwardly onto the seat 16 by the action of a spring 24.

Various forces are provided to act upon the flow tube 22 to control the opening and closing of the flapper 18. Thus, biasing means, such as a spring 26, may act between a shoulder 28 on the valve body 12 and a shoulder 30 connected to the flow tube 22 for yieldably urging the flow tube 22 in an upward direction to release the flapper 18 for closing the valve 10. The valve 10 is controlled by the application or removal of a pressurized fluid, such as hydraulic fluid, through a control path or line, such as control line 32 (FIG. 1A), extending to the well surface or the casing annulus for supplying a pressurized hydraulic fluid to passageway 33 and to the top of one or more pistons 40 which in turn act on the flow tube 22 to move the flow tube downwardly forcing the flapper 18 off of the seat 16 and into the full open position. If the fluid pressure in the conduit 32 is reduced sufficiently relative to the forces urging the flow tube 22 upwardly, the flow tube 22 will be moved upwardly beyond the seat 16 allowing the valve 10 to close.

The above description of one type of subsurface safety valve is generally disclosed in U.S. Pat. No. 4,161,219.

Once the valve 10 is closed with the flapper valve element 18 seated on the seat 16 it is usual that there is a greater existing pressure in the bore 14 below the flapper 18 than above the flapper 18. This holds the flapper 18 seated with a high differential pressure and it is therefore desirable to equalize the pressure across the flapper 18 before reopening in order to be able to open the flapper against the differential pressure and to prevent the high velocities of fluid flow through the opening flapper 18 in valve seat 16 from being damaged by erosion. Therefore, it is conventional to utilize an equalizing valve which is opened prior to the opening of the first valve or flapper 18 to equalize pressure across the flapper 18. However, the equalizing valve itself may fail as the result of the fluid flow erosion due to high velocity flow and/or high pressure for an extended period of time.

Referring now to FIGS. 1B, 1C, 1D and 1E, one or more equalizing lines and equalizing valves, preferably two, are provided in the housing 12 having a lower end 44 in communication with the space below the valve seat 16 and an upper end extending through port 46 into the upper portion of the bore 14. Thus when the equalizing line 42 is opened fluid may flow from below the first valve consisting of the flapper 18 and valve seat 16 (when the flapper 18 is closed as will be more fully described hereinafter) and up through the port 46 and into the bore 14 above the flapper 18.

An equalizing valve generally indicated by the reference numeral 50 is provided in each equalizing line 42 and consists of a valve seat 52 and a valve element 54. When the valve element 54 is seated on the seat 52 the equalizing line 42 is closed. An actuating stem 56 is connected to the valve element 54 and to a piston 58 which is exposed on its top side to hydraulic control pressure leading to the well surface such as being in communication with a passageway 60 which in turn is in communication with the conduit 32 and fluid passageway 33 to the pistons 40. However the piston 58 may be in communication with a separate hydraulic control line to the well surface. Therefore, the application of hydraulic pressure to the top of the piston 58 acts in a direction to move the valve element 54 off of the seat 52 and open the equalizing valve. The equalizing valve 50 is biased to a closed position by a spring 62.

Figure 1B:
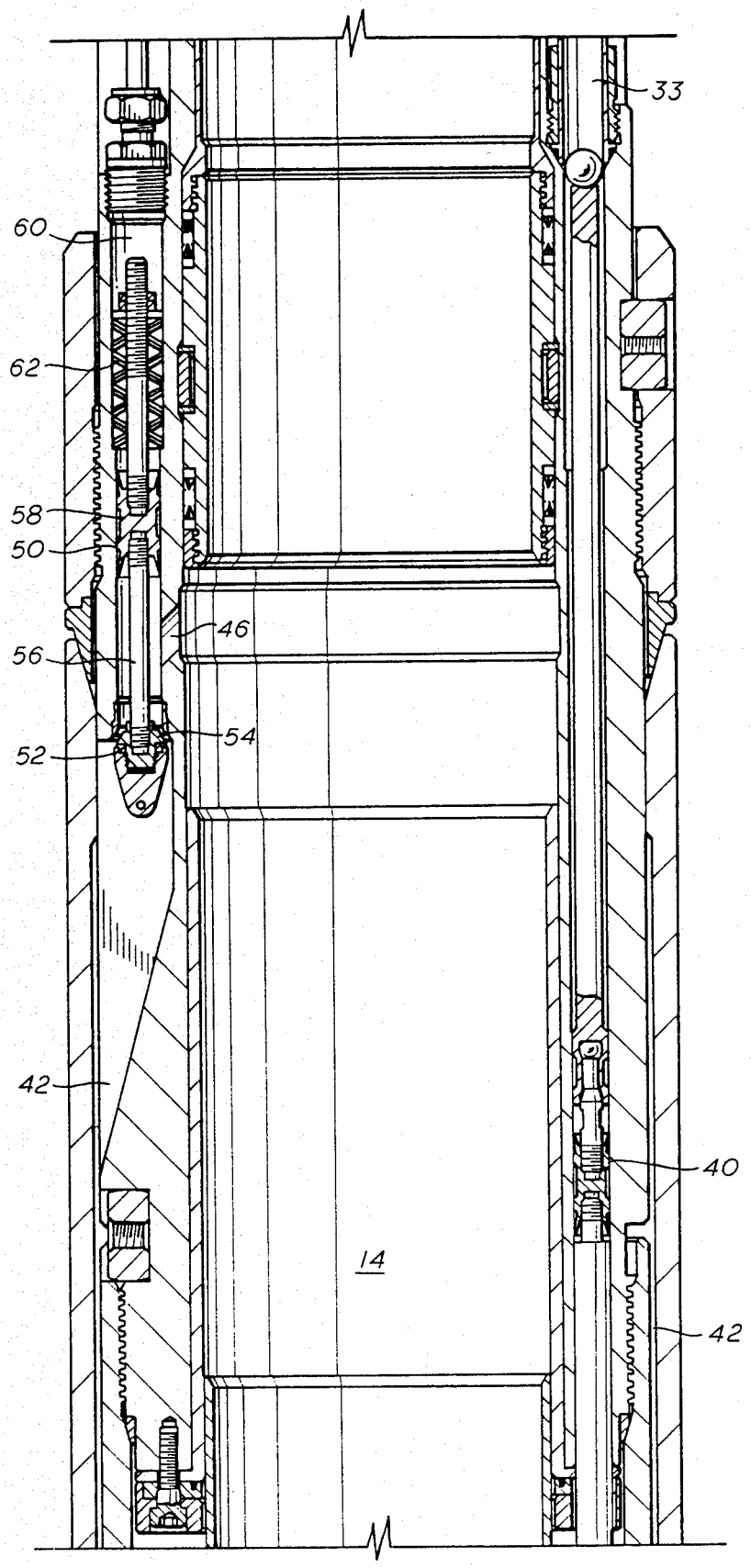

Referring now to FIG. 1B, the equalizing line 42 includes a labyrinth passageway 70 for creating control pressure drops along the equalizing line 42 to reduce the pressure and flow velocity through the equalizing line 42 to minimize the flow cutting and erosion of the equalizing valve element 54 and seat 52 thereby increasing the life of the equalizing valve 50. While the labyrinth passageway may be of any suitable undultory passageway which offers resistance to fluid flow the preferred form is an alternate series of ridges 72 and grooves 74 which extend along the equalizing line 42 and are positioned upstream of the equalizing valve 50. For example only, while the pressure of the well fluid at the lower end of the equalizing line 42 at end 44 is 5,000 psi, by the provision of the multiple pressure drops across the plurality of grooves 74 and ridges 72 the pressure could be dropped to any desired amount, such as, for example, 200 psi, and slowing the velocity of the equalizing fluid flowing through the equalizing line 42 thereby preventing high velocity fluid flow through the valve 50.

The length of the labyrinth passageway 70 may be made to accommodate the particular pressures involved in the well. The advantage of the laybrinth passageway 70 is that it can be sized to obtain total control of the pressure drop and velocities through the equalizing line 42 for reducing erosion of the equalizing valve 50.

Normally, the width of the passageway 70 between the ridges 72 and the opposing wall are normally from 10 to 20 thousands of an inch. However, the size of the passageway must be changed depending upon the conditions existing in the well in which the safety valve is installed. For example, depending upon the viscocity of the flowing well production the size of the passageway must be varied to be set for the desired pressure drop to occur. In addition, in gas wells and oil wells with an abundance of sand in the production fluid the size of the passageway must also be changed. The present invention is directed to providing a variable flow passageway. This has the advantage of manufacturing a plurality of various different safety valves having different size passageways. The provision of a variable sized passageway 70 also eliminates the need to hold extremely close tolerances in manufacturing the valves as the size of the passageway can easily be changed irrespective of the tolerances.

Figure 1C:
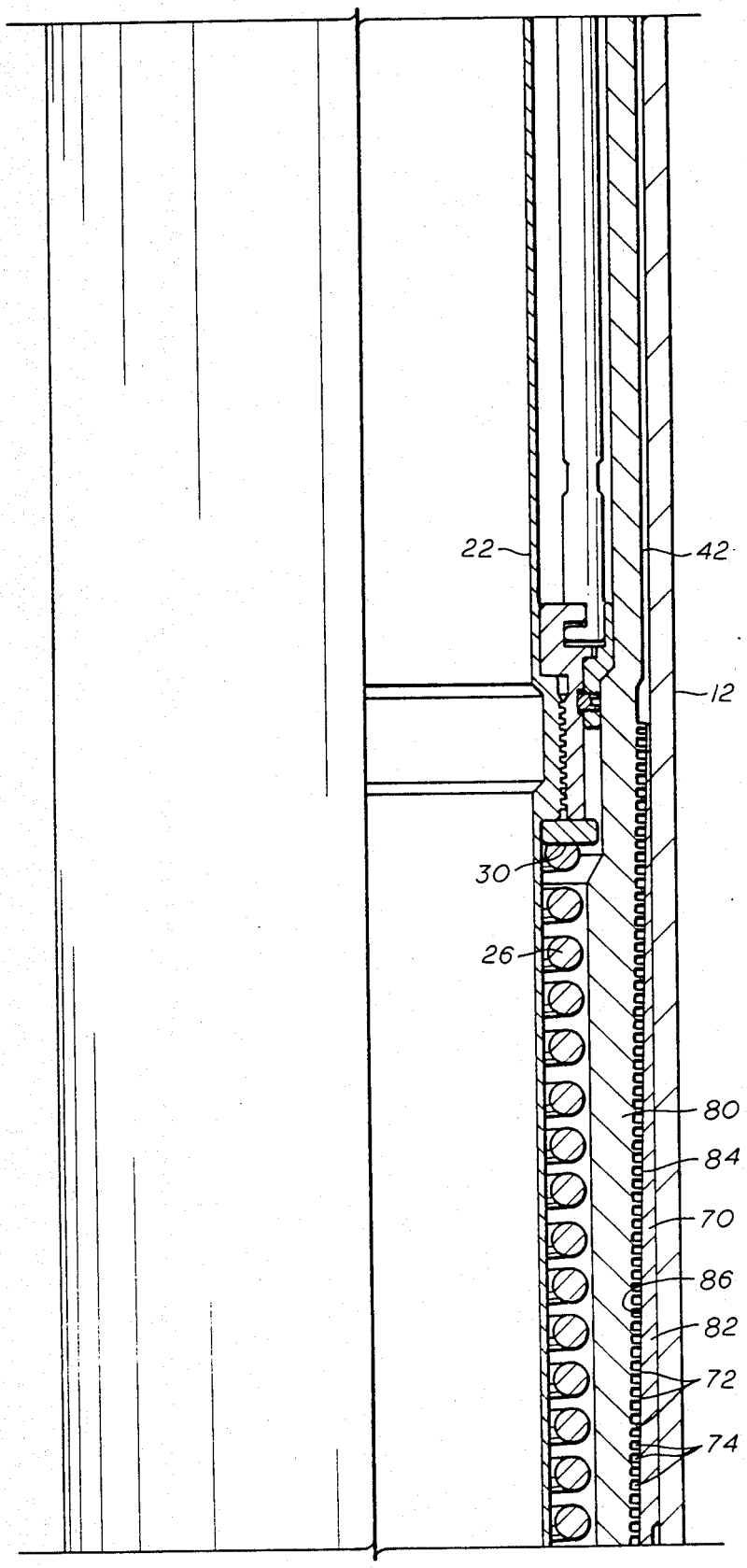
Figure 1D:
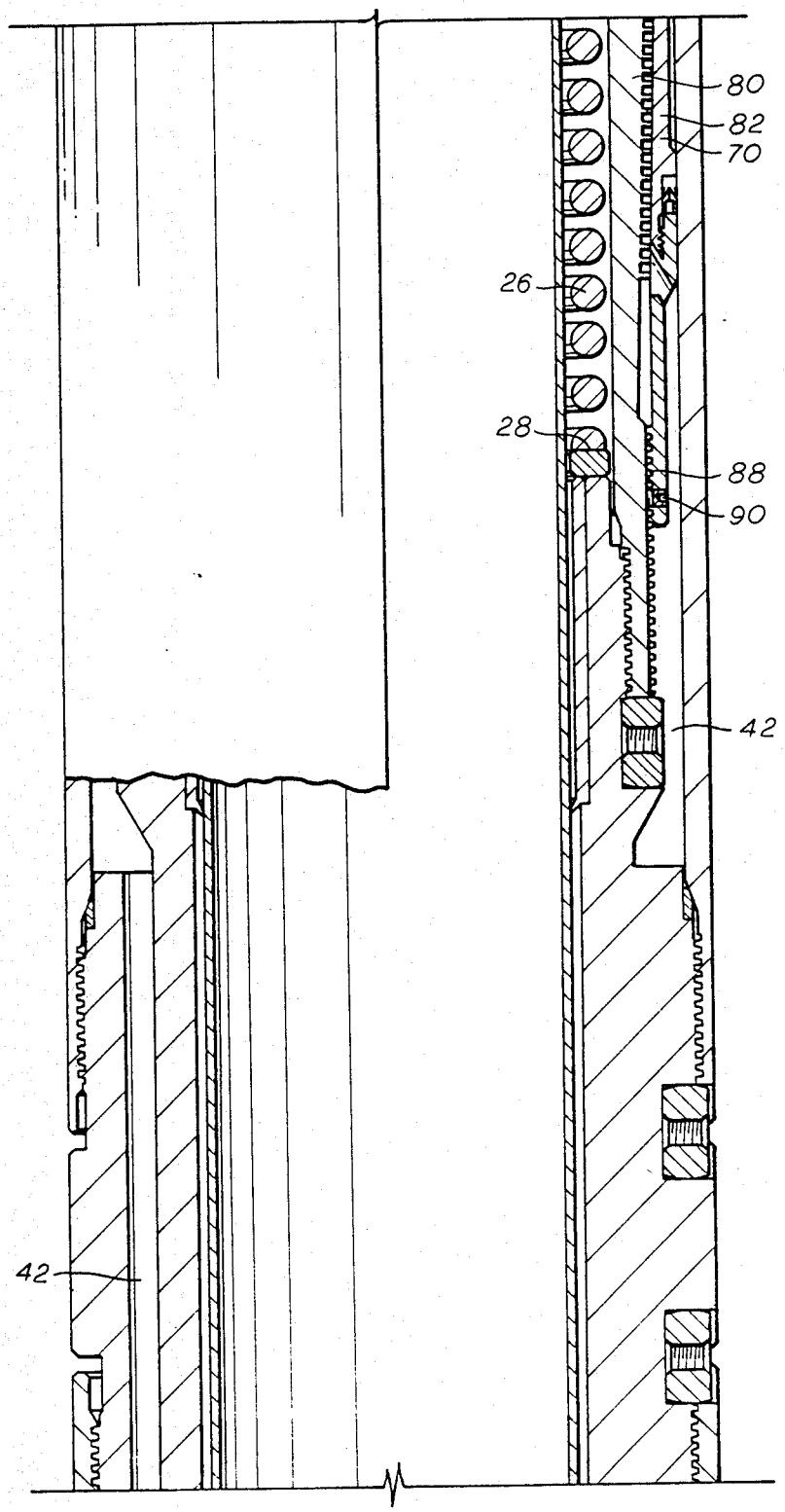
Figure 1E:
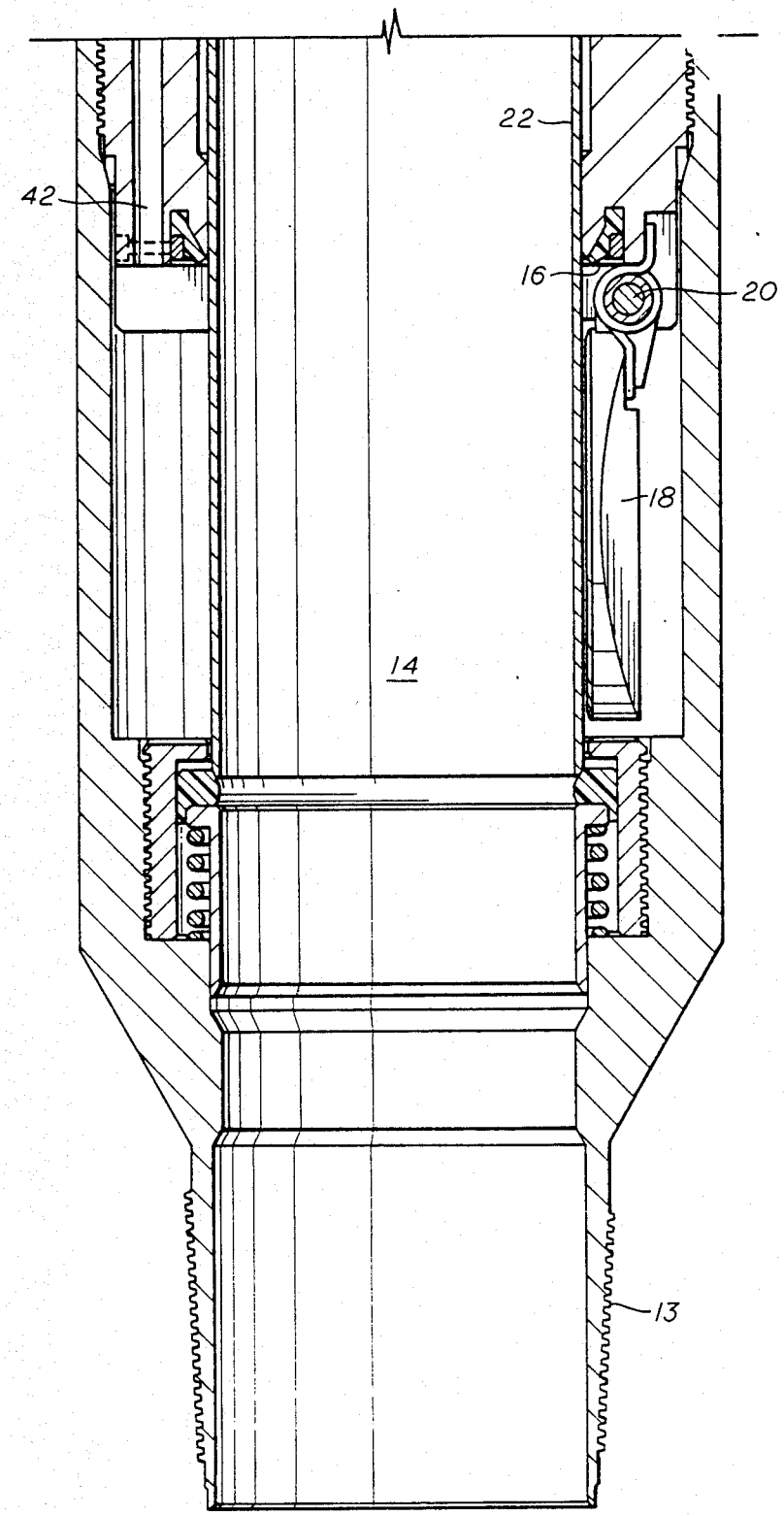

Referring now to FIGS. 1C and 1D, the passageway 70 is formed by first 80 and second 82 vertically positioned members spaced from each other. The first member 80 has a tapered surface 84 which includes the plurality of grooves 74 and ridges 72. The second member 82 is preferably a sleeve having a tapered surface 86 facing the grooves 74 and ridges 72. One of the members, preferably the sleeve 82 is longitudinally movable relative to the first member 80 for adjusting the space between the members 80 and 82 thereby adjusting the size of the passageway 70. For example, the member 82 includes a threaded connection 88 with the member 80. The threaded connection 88 may be a six pitch Acme thread whereby one revolution of the sleeve 82 relative to the member 80 changes the gap or size of the passageway 0.003 inches. After the sleeve 82 is rotated to set the size of the passageway 70, locking means such as a set screw 90 is provided for locking the first member 80 and the second member 82 together. Therefore, by rotating the sleeve 80 and thus longitudinally moving the sleeve 80, the size of the passageway 70 may be increased or decreased depending upon the well conditions in which the valve 10 is to be used.

Figure 2A:
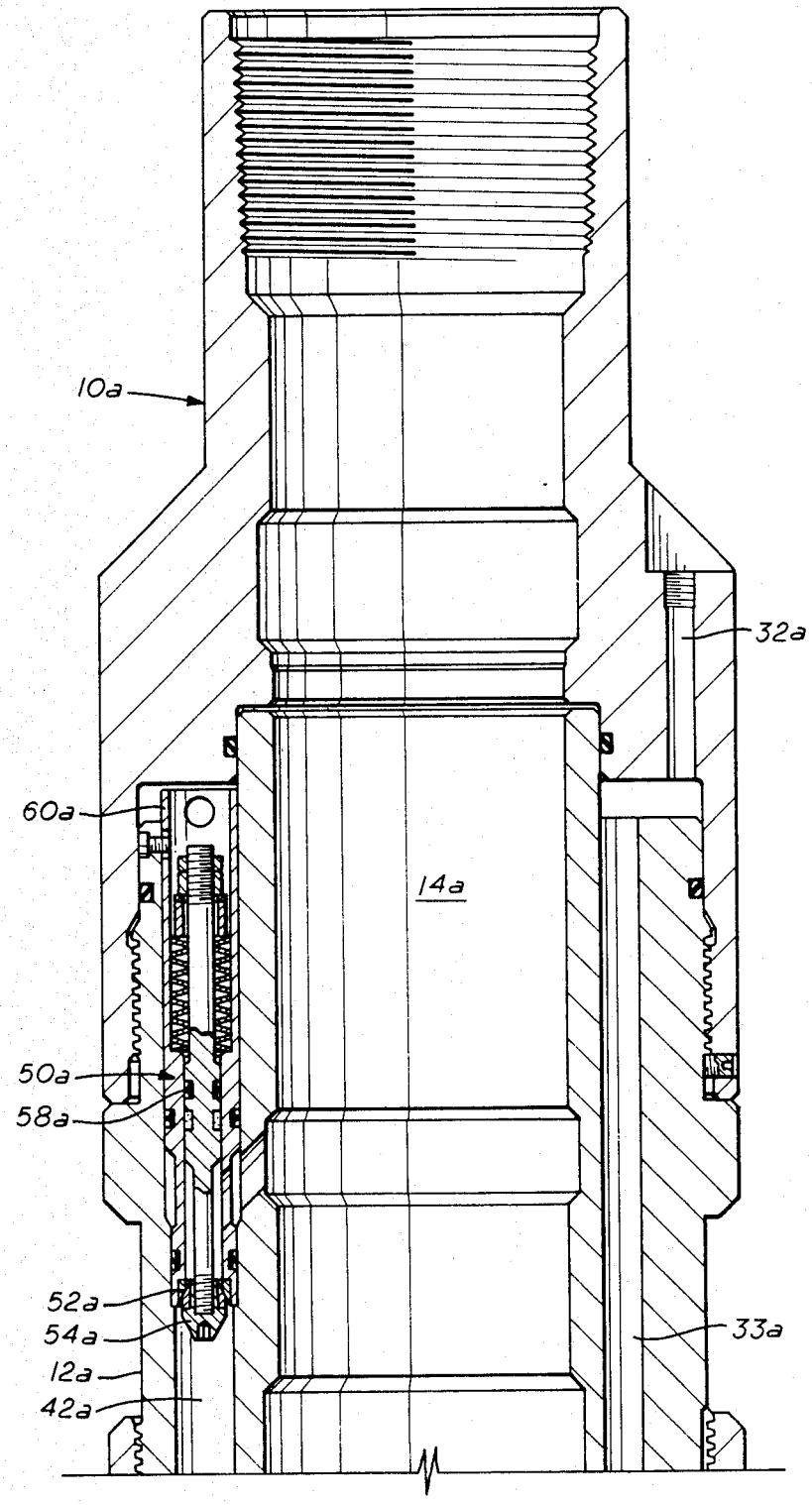
FIGS. 2A, 2B, 2C and 2D are continuations of each other and form an elevational view, in cross-section, of another embodiment of a well safety valve utilizing the present invention.
Figure 2B:
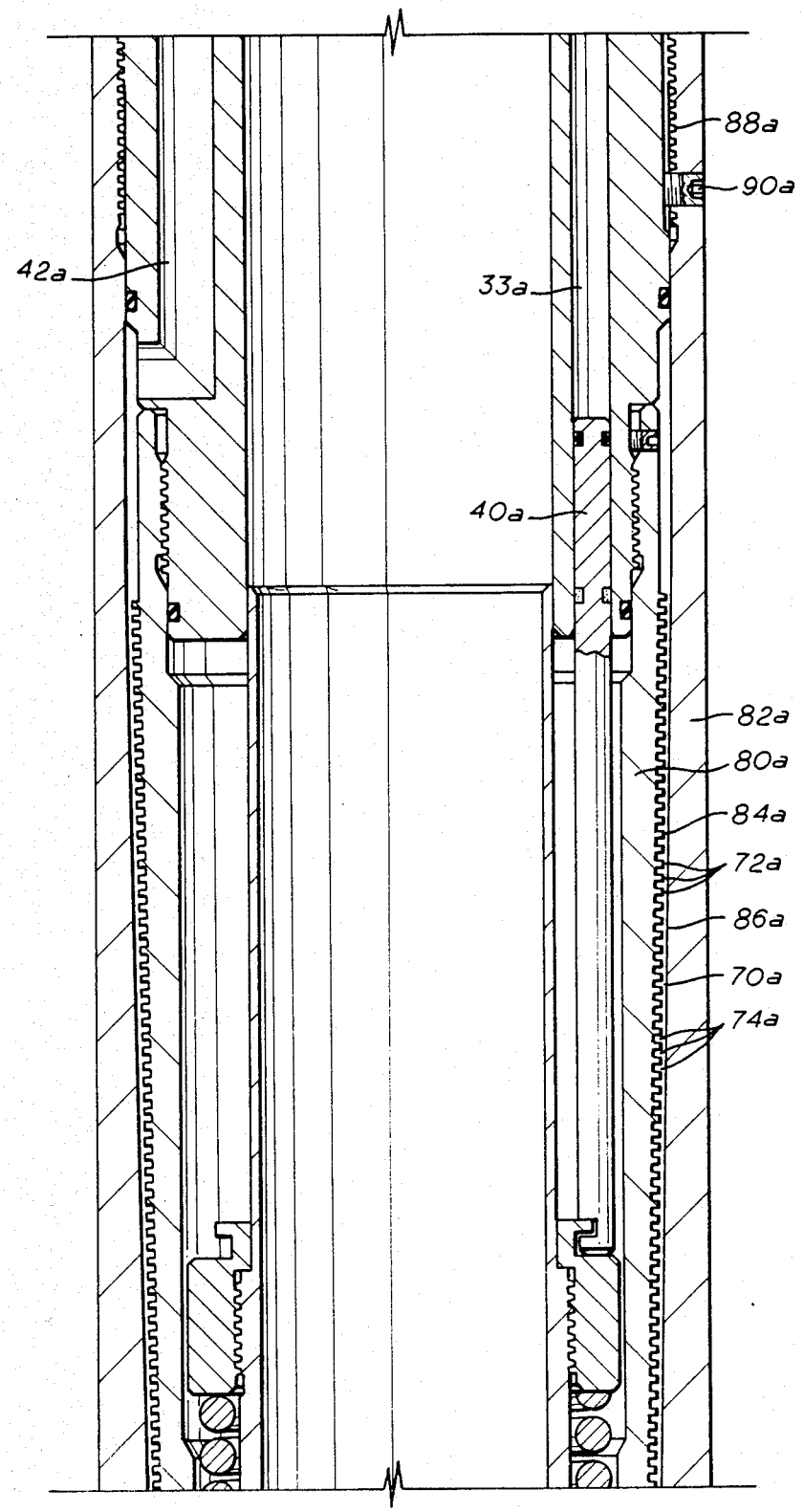
Figure 2C:
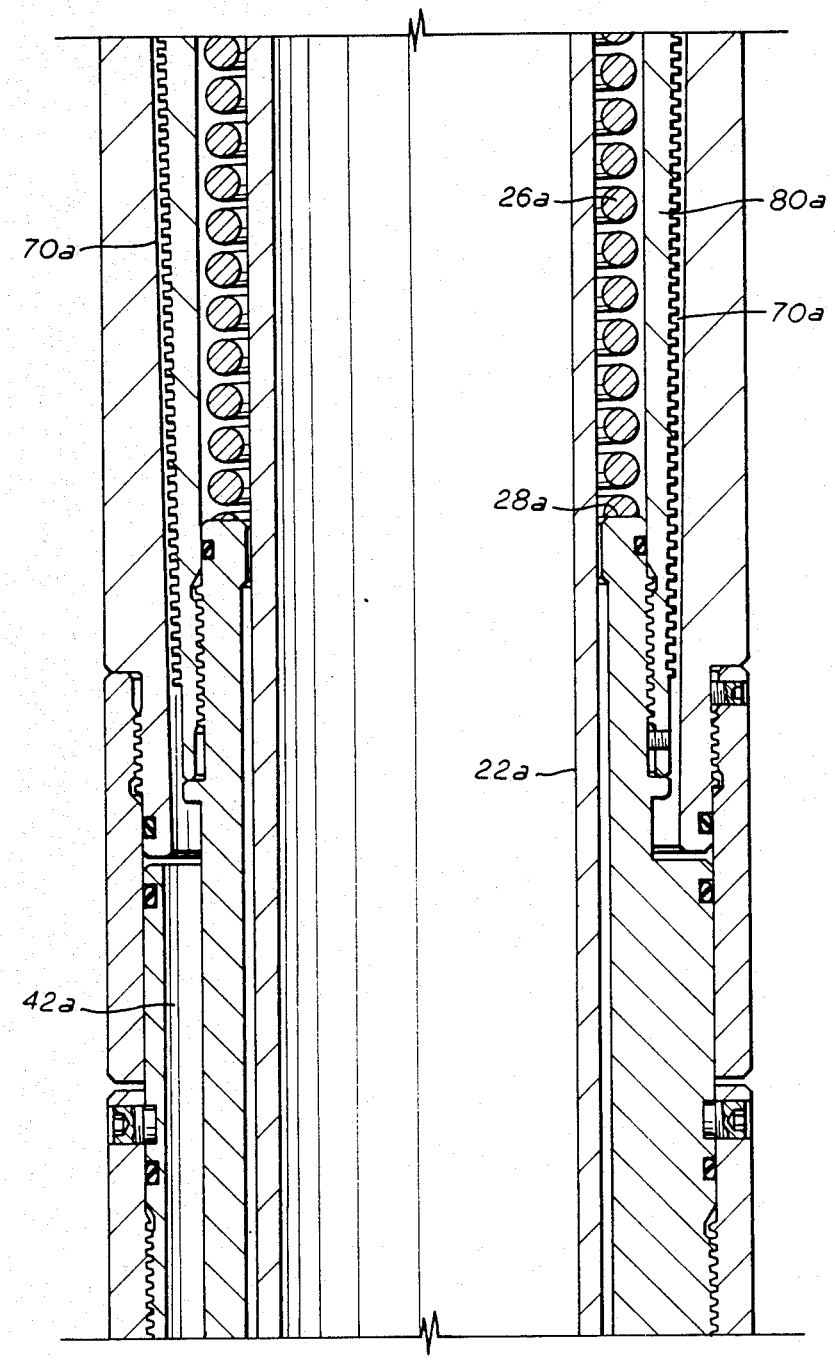
Figure 2D:
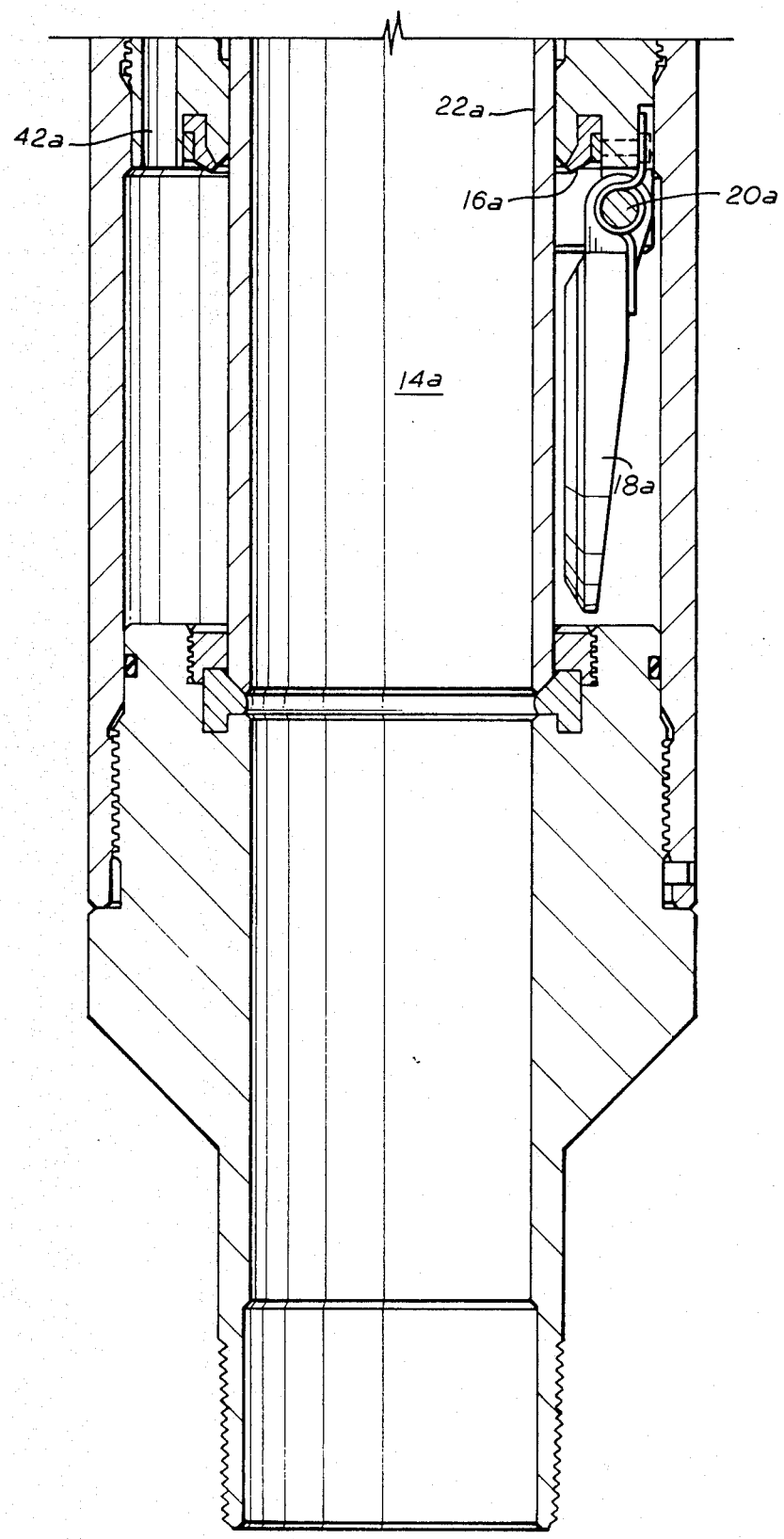

Other and further modifications of the invention may be used such as shown in FIGS. 2A, 2B, 2C and 2D wherein like parts to those previously disclosed are similarly numbered with the addition of the suffix "a". As best seen in FIGS. 2B and 2C, the passageway **70*a* is formed by the first member 80*a* and the second member 82*a*. The first member 80*a* includes a tapered surface 84*a* containing the plurality of grooves 74*a* and ridges 72*a*. One of the members is fixed, here shown as member 80*a* although, of course, the second member 82*a* could be fixed and the member 80*a* could be movable. In this embodiment the second member 82*a* includes an outer portion of the housing 12*a* and is longitudinally movable relative to the first member 80*a* by threads 88*a* connected to the housing 12*a*. The members 80*a* and 82*a* may be releasably locked together by set screw 90*a* after adjustment of the size of the passageway 70*a***.

In operation, when it is desired to open the valve 10, hydraulic control pressure is applied to the control line 32 and passageways 33 and 60. With the flapper 18 in the closed position, the fluid forces and spring forces on the equalizing valve 50 are adjusted to cause the equalizing valve 50 to open prior to and at a lower hydraulic control pressure than the movement of the pistons 40 to cause the flapper 18 to open. This allows equalizing of the pressure across the closed flapper 18. During this time, the labyrinth passageway 70 creates a plurality of pressure drops along the passageway 70 to reduce the velocity of fluid flow through the valve seat 52 and around the valve element 54 thereby reducing erosion. The equalizing time may be adjusted by varying the length and clearance in the labyrinth passageway 70 to optimize the length of operation as a function of the desired pressure drop and fluid velocities.

After the valve 10 has been suitably equalized, additional fluid pressure from the control line 32 will act upon the pistons 40 to move the flow tube 22 downwardly to move the flapper 18 off of the seat 16 thereby opening the valve. The flapper 22 will move downwardly and engage the lower seal 80 thereby blocking the lower end 44 of the equalizing line 42 from the well bore 14 thereby preventing fluid flow through the equalizing means while the valve 10 is open. When it is desired to close the valve 10, the hydraulic control pressure in the line 32 is reduced and the valve 50 has been adjusted to insure that the equalizing valve 50 closes before the flapper 18 begins to close thereby limiting the fluid flow through the open equalizing valve 50 as the main valve closes.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a well tool having a housing and a pressure reducing and fluid velocity reducing passageway, the improvement comprising, said passageway formed by first and second vertically positioned members spaced from each other, said first member having a tapered surface including a plurality of grooves and ridges, said second member having a tapered surface facing the grooves and ridges, and means for longitudinally moving one of the members relative to the other member for adjusting the space between the members thereby adjusting the size of the passageway.

2. The apparatus of claim 1 wherein the moving means includes thread means between the one member and the housing.

3. The apparatus of claim 2 wherein the one member includes an outer portion of the housing.

4. The apparatus of claim 2 wherein the one member is a sleeve inside the housing.

5. The apparatus of claim 2 including, locking means for locking said first and second members together after adjustment of the size of the passageway.

6. In combination with a subsurface well safety valve for controlling fluid flow through a well tubing and having a housing, a first valve being movable between an open and closed position for controlling flow through the housing, a flow tube telescopically movable in the housing for controlling the opening and closing of said first valve, and means for moving the flow tube for opening and closing the first valve, and an equalizing means for reducing the pressure differential across the first valve when opening said first valve comprising, an equalizing line in communication with the inside of said housing between points below and above the first valve, an equalizing valve in said line, said equalizing valve opening prior to the opening of the first valve, and a labyrinth passageway in said equalizing line upstream of the equalizing valve for providing pressure drops for controlling the velocity of the fluid flowing through the equalizing valve, said passageway formed by first and second vertically positioned members spaced from each other, said first member having a tapered surface including a plurality of grooves and ridges, said second member having a tapered surface facing the grooves and ridges, and means for longitudally moving one of the members relative to the other member for adjusting the space between the members thereby adjusting the size of the passageway.

7. The apparatus of claim 6 wherein the moving means includes thread means between the one member and the housing.

8. The apparatus of claim 7 wherein the one member includes an outer portion of the housing.

9. The apparatus of claim 7 wherein the one member is a sleeve inside the housing.

10. The apparatus of claim 7 including, locking means for locking said first and second members together after adjustment of the size of the passageway.

* * * * *